US009683305B2

(12) United States Patent
Akana et al.

(10) Patent No.: US 9,683,305 B2
(45) Date of Patent: Jun. 20, 2017

(54) METAL SURFACE AND PROCESS FOR TREATING A METAL SURFACE

(75) Inventors: Jody R. Akana, San Francisco, CA (US); Peter N. Russell-Clarke, San Francisco, CA (US); Masashige Tatebe, Hyogo (JP)

(73) Assignee: Apple Inc., Cupertino, CA (US)

( * ) Notice: Subject to any disclaimer, the term of this patent is extended or adjusted under 35 U.S.C. 154(b) by 918 days.

(21) Appl. No.: 13/332,288

(22) Filed: Dec. 20, 2011

(65) Prior Publication Data

US 2013/0153428 A1 Jun. 20, 2013

(51) Int. Cl.

| | |
|---|---|
| ***C25D 11/20*** | (2006.01) |
| ***B44C 1/00*** | (2006.01) |
| ***C25D 11/30*** | (2006.01) |
| ***C25D 11/16*** | (2006.01) |
| ***C25D 11/12*** | (2006.01) |
| ***C25D 11/26*** | (2006.01) |
| ***C25D 11/22*** | (2006.01) |
| ***C25D 11/24*** | (2006.01) |
| ***C25D 11/34*** | (2006.01) |
| ***C25D 11/02*** | (2006.01) |

(52) U.S. Cl.

CPC ..... *C25D 11/20* (2013.01); *B44C 1/005* (2013.01); *C25D 11/022* (2013.01); *C25D 11/12* (2013.01); *C25D 11/16* (2013.01); *C25D 11/22* (2013.01); *C25D 11/243* (2013.01); *C25D 11/246* (2013.01); *C25D 11/26* (2013.01); *C25D 11/30* (2013.01); *C25D 11/34* (2013.01)

(58) Field of Classification Search

CPC ..... H01L 21/31144; C25D 11/16; C25D 5/02; C25D 11/022; C23C 28/00

USPC ..... 205/50, 205, 208, 210, 199

See application file for complete search history.

(56) References Cited

U.S. PATENT DOCUMENTS

| | | | | |
|---|---|---|---|---|
| 3,016,293 | A | | 1/1962 | Cybriwsky et al. |
| 3,099,610 | A | * | 7/1963 | Cybriwsky et al. ..... 205/198 |
| 3,284,321 | A | | 11/1966 | Fromson |
| 4,093,754 | A | | 6/1978 | Parsons |
| 4,133,919 | A | | 1/1979 | Parsons |

(Continued)

FOREIGN PATENT DOCUMENTS

| | | |
|---|---|---|
| CN | 1222943 | 7/1999 |
| CN | 1125891 C | 10/2003 |

(Continued)

OTHER PUBLICATIONS

Capp et al. "Glass Etching: 46 Full-size Patterns with Complete Instructions" New York: Dover, p. 7-8, 1984.*

(Continued)

*Primary Examiner* — Louis Rufo
(74) *Attorney, Agent, or Firm* — Downey Brand LLP

(57) ABSTRACT

A surface treatment for metal surfaces can be used to create one or more desired effects, such as functional, tactile, or cosmetic effects. In one embodiment, the treatment involves selectively masking a portion of the surface using a photolithographic process. The mask can protect the masked portion of the surface during subsequent treatment processes such as texturizing and anodization. The mask can result in the creation of a surface having contrasting effects. A pattern can be formed by the contrasting effects in the shape of a distinct graphic, such as a logo or text.

16 Claims, 8 Drawing Sheets

(56) References Cited

U.S. PATENT DOCUMENTS

| | | | | |
|---|---|---|---|---|
| 4,148,204 | A | 4/1979 | Dötzer et al. | |
| 4,389,482 | A | 6/1983 | Bargon et al. | |
| 4,445,982 | A | 5/1984 | Royer | |
| 4,589,972 | A * | 5/1986 | Pompea | C25D 11/16 126/908 |
| 4,801,490 | A | 1/1989 | Schuette | |
| 4,966,664 | A * | 10/1990 | Buerk et al. | 205/705 |
| 5,006,207 | A | 4/1991 | Peterman et al. | |
| 5,593,528 | A | 1/1997 | Dings et al. | |
| 5,718,618 | A | 2/1998 | Guckel et al. | |
| 6,132,930 | A * | 10/2000 | Hayashi et al. | 430/270.1 |
| 6,139,713 | A | 10/2000 | Masuda et al. | |
| 6,342,145 | B1 * | 1/2002 | Houssian | C25D 11/12 205/122 |
| 6,790,335 | B2 * | 9/2004 | Lai | 205/205 |
| 6,866,561 | B2 | 3/2005 | Andrews | |
| 7,563,382 | B2 * | 7/2009 | Osawa | 216/47 |
| 7,931,939 | B2 | 4/2011 | Yamaguchi | |
| 2003/0035917 | A1 * | 2/2003 | Hyman | 428/67 |
| 2003/0162385 | A1 | 8/2003 | Preusse et al. | |
| 2003/0219609 | A1 | 11/2003 | Nishimura | |
| 2004/0094426 | A1 | 5/2004 | Lai | |
| 2004/0191423 | A1 | 9/2004 | Ruan et al. | |
| 2005/0109623 | A1 | 5/2005 | Lee | |
| 2005/0271828 | A1 | 12/2005 | Saito et al. | |
| 2006/0260947 | A1 | 11/2006 | Kia et al. | |
| 2007/0212558 | A1 | 9/2007 | Gao et al. | |
| 2008/0149492 | A1 | 6/2008 | Lin et al. | |
| 2008/0274375 | A1 | 11/2008 | Ng et al. | |
| 2010/0051467 | A1 * | 3/2010 | Tian | C25D 5/02 205/118 |
| 2011/0017602 | A1 * | 1/2011 | Khosla | C25D 5/02 205/50 |
| 2011/0017603 | A1 | 1/2011 | Cheng | |
| 2011/0056836 | A1 | 3/2011 | Tatebe et al. | |
| 2012/0267989 | A1 * | 10/2012 | Guan et al. | 312/204 |
| 2013/0081951 | A1 | 4/2013 | Hankey et al. | |
| 2013/0153427 | A1 | 6/2013 | Tatebe | |

FOREIGN PATENT DOCUMENTS

| | | | |
|---|---|---|---|
| CN | 1456712 | | 11/2003 |
| CN | 101033553 | A | 9/2007 |
| CN | 101922010 | | 12/2010 |
| CN | 102189888 | | 9/2011 |
| EP | 0001138 | | 3/1979 |
| EP | 0086131 | | 1/1983 |
| EP | 0459461 | | 12/1991 |
| EP | 1510863 | | 3/2005 |
| GB | 2070647 | | 9/1981 |
| JP | S5419438 | A | 2/1979 |
| JP | S5490031 | | 7/1979 |
| JP | S5930669 | A | 2/1984 |
| JP | 64073080 | | 3/1989 |
| JP | H03253595 | | 11/1991 |
| JP | 04036477 | | 2/1992 |
| JP | H1170797 | A | 3/1999 |
| JP | 11-236697 | | 8/1999 |
| JP | 11236697 | | 8/1999 |
| JP | 2003031654 | A | 1/2003 |
| JP | 2010030177 | A | 2/2010 |
| KR | 1020100084204 | | 7/2010 |
| TW | 200949022 | | 12/2009 |
| TW | 201011127 | | 3/2010 |
| WO | WO0120647 | | 3/2001 |
| WO | 2011028392 | A1 | 3/2011 |

OTHER PUBLICATIONS

PCT/US2012/057632—International Search Report and Written Opinion, mailed Mar. 29, 2013.
Taiwanese Patent Application No. 101136087—Office Action dated Jan. 8, 2014.
Co-pending U.S. Appl. No. 13/250,588, filed Sep. 30, 2011 (Not Published).
Co-pending U.S. Appl. No. 13/331,892, filed Dec. 20, 2011 (Not Published).
Japanese Patent Application No. 2014-526051—Office Action dated Dec. 15, 2014.
PCT/US2012/049192—Int'l Search Report & Written Opinion dated Nov. 28, 2012.
PCT/US2012/057632—Int'l Search Report & Written Opinion dated Mar. 29, 2013.
Japanese Patent Application No. 2014-526051—Office Action dated Jul. 8, 2015.
Chinese Application for Invention No. 201280060778.0—First Office Action dated Sep. 29, 2015.
European Patent Application No. 12859107—Supplementary Search Report dated Jul. 30, 2015.
Korean Patent Application No. 10-2014-7017166—Office Action dated Sep. 11, 2015.
Chinese Patent Application No. 201280039932.6—Office Action dated Jun. 25, 2015.
Zhu Zufang, Technique of Anodization and Surface Treatment of Aluminum Alloy Anodes, Jul. 31, 2004, 17 pgs., 1st edition, Chemical Industry Press.
Notification of the Second Office Action and Search Report for Chinese Patent Application No. 201280060778.0 from the State Intellectual Property Office of the People's Republic of China mailed Apr. 29, 2016.
Japanese Patent Application No. 2014-549031—Office Action dated Nov. 28, 2016.
Chinese Patent Application No. 201280060778.0—Office Action dated Dec. 15, 2016.

* cited by examiner

METAL SURFACE AND PROCESS FOR TREATING A METAL SURFACE

BACKGROUND

Field

The present invention relates to treatments for a metal surface of an article and an article with such a metal surface.

Background

Products in the commercial and consumer industries can be treated by any number of processes to create one or more desired surface effects, such as functional, tactile, or cosmetic surface effects. One example of such a process is anodization. Anodization converts a portion of a metal surface into a metal oxide to create a metal oxide layer. Anodized metal surfaces provide increased corrosion and wear resistance and can also be used to achieve a desired cosmetic effect.

A surface can also be texturized to roughen the surface, shape the surface, remove surface contaminants, or other desired effects. This texturizing process can be accomplished via one or more mechanical processes such as by machining, brushing, or abrasive blasting. Alternatively, a surface can be texturized through a chemical process, such as by chemical etching.

The effects of surface treatments can be of great importance. In consumer product industries, such as the electronics industry, visual aesthetics can be a deciding factor in a consumer's decision to purchase one product over another. Accordingly, there is a continuing need for new surface treatments, or combinations of surface treatments, for providing surfaces with desired effects.

BRIEF SUMMARY

In broad terms, a metal surface of an article can be treated to create one or more desired effects, such as functional, tactile, or cosmetic effects. A method of treating the surface of an article can include forming a mask by selectively masking a portion of the surface using a photolithographic process. The mask covers a portion of the surface during subsequent treatment processes, such as texturizing and anodization, which results in a surface having contrasting effects. For example, a pattern formed by the contrasting effects can form a distinct graphic, such as a logo or text.

The photolithographic process can include applying a photoresist to the surface. In one example, a portion of the photoresist is covered, and an uncovered portion of the photoresist is exposed to light to develop the uncovered portion. The covered portion is left undeveloped. The undeveloped portion of the photoresist is then removed from the surface and the developed portion is heated to harden the photoresist into a mask. The mask can be removed before or after a subsequent treatment, such as texturizing, anodizing, dying, sealing, and polishing to achieve a desired surface effect.

Additional features of the invention will be set forth in the description that follows, and in part will be apparent from the description, or may be learned by practice of the invention. Both the foregoing general description and the following detailed description are exemplary and explanatory and are intended to provide further explanation of the invention.

BRIEF DESCRIPTION OF THE FIGURES

The accompanying figures, which are incorporated herein, form part of the specification and illustrate exemplary embodiments of the present invention. Together with the description, the figures further serve to explain the principles of, and to enable a person skilled in the relevant art(s) to make and use the exemplary embodiments described herein.

DETAILED DESCRIPTION

The following detailed description refers to the accompanying figures, which illustrate exemplary embodiments. Other embodiments are possible. Modifications may be made to the exemplary embodiments described herein without departing from the spirit and scope of the present invention. Therefore, the following detailed description is not meant to be limiting. The operation and behavior of the embodiments presented are described with the understanding that modifications and variations may be within the scope of the present invention.

Figure 1:
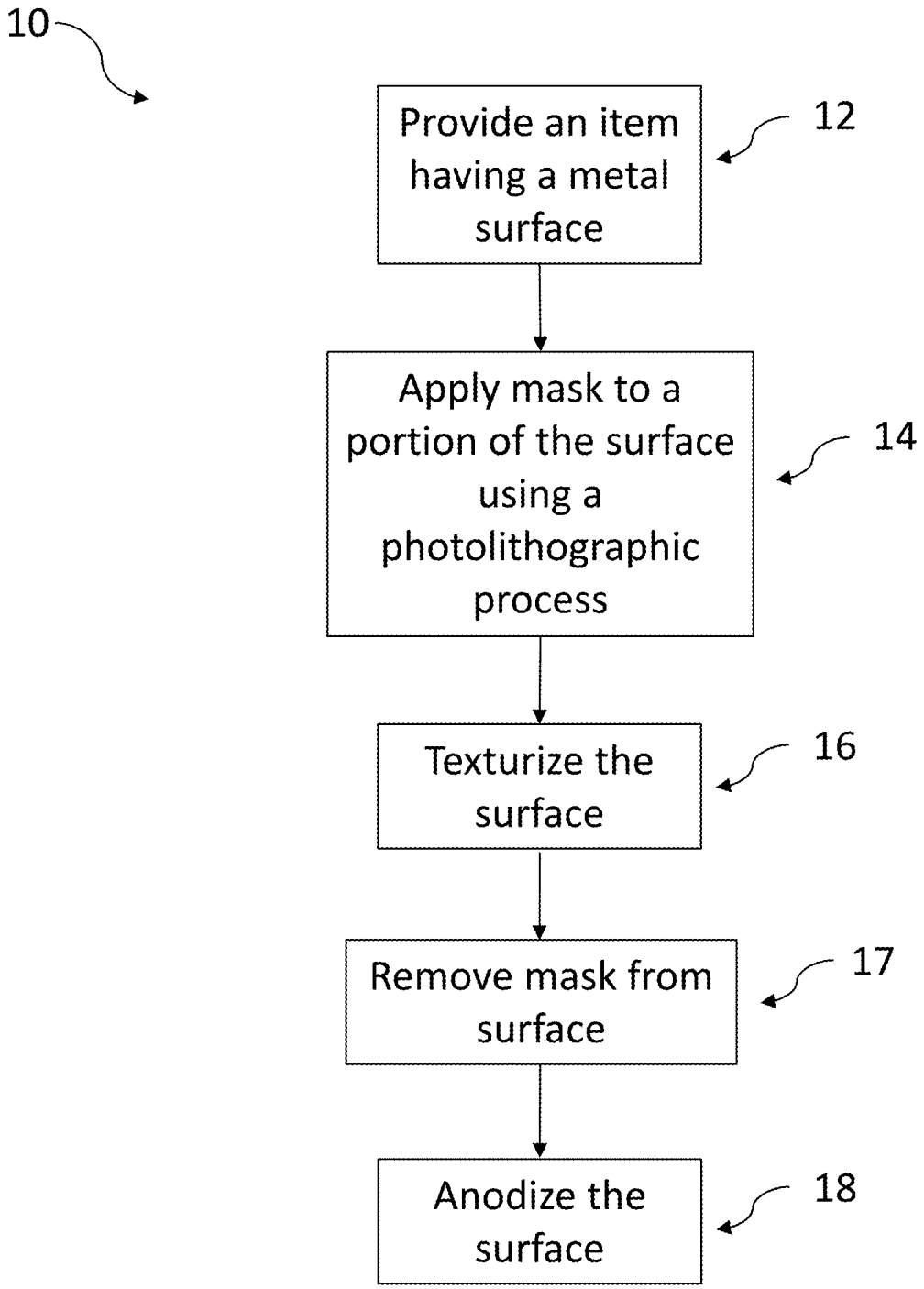
FIG. 1 is a flowchart of a surface treatment process in accordance with one embodiment of the present application.

FIG. 1 is a high-level flowchart of an exemplary surface treatment process 10. Process 10 includes an act 12 of providing an article having a metal surface, such as a metal part having a metal surface. Any of the processes described herein can be applied to a broad range of metal parts including, but not limited to, household appliances and cookware, such as pots and pans; automotive parts; athletic equipment, such as bikes; and parts for use with electronic components, such as housings or other components for laptop computers, housings or other components for handheld electronic devices, such as tablet computers, media players, and phones, and housings or other components for other electronic devices, such as desktop computers. In some embodiments, the process can be implemented on a housing for a media player or laptop computer manufactured by Apple Inc. of Cupertino, Calif.

Suitable metal surfaces include aluminum, titanium, tantalum, magnesium, niobium, stainless steel, and the like. A metal part including a metal surface can be formed using a variety of techniques, and can come in a variety of shapes, forms and materials. For example, the metal part can be provided as a preformed sheet. In another example, the metal part can be extruded so that the metal part is formed in a desired shape. Extrusion can produce a desired shape of indeterminate length so that the material can be subsequently cut to a desired length. In one embodiment, the metal part can be shape cast via any suitable casting process, such as die casting or permanent mold casting processes, among others. In one embodiment, the metal part can be formed from aluminum, such as extruded 6063 grade aluminum for example. In some embodiments, the metal part is made of an aluminum-nickel or aluminum-nickel-manganese casting alloy or other aluminum alloy suitable for casting. In some embodiments, the metal part can include a non-metal substrate, such as plastic, with a surface layer of metal joined thereto. The choice of any materials described herein can be further informed by mechanical properties, temperature sensitivity, or any other factor apparent to a person having ordinary skill in the art.

Process 10 further includes an act 14 of applying a mask to a portion of the surface. In one embodiment, the mask can be applied using a photolithographic process to form a masked portion. In other embodiments, a mask can be applied using other methods, such as screen printing, pad printing, or by application of a pre-formed mask, such as a metal patch, plastic label, etc. Another portion of the surface can remain unmasked and form an unmasked portion. As described in further detail below, in the embodiment masked using a photolithographic process, a photoresist is applied to the surface. The photoresist can be an epoxy-based polymer. For example, the photoresist can be SU-8 negative photoresist, which is manufactured by MicroChem. Inc. of Newton, Mass. The photoresist can be any other suitable positive or negative resist. A portion of the photoresist is covered, and the uncovered portion of the photoresist is exposed to a light source configured to render the photoresist either soluble or insoluble as desired. The remaining soluble photoresist is removed from the surface. The resulting mask can serve to protect the portion of the surface during one or more subsequent acts as described herein, such as texturizing, anodizing, and polishing. This can result in two portions of the same surface having different effects, such as functional, tactile, or cosmetic effects.

A portion of the photoresist is then covered using, for example, a photomask having an opaque plate with holes or transparencies that are configured to allow light to shine through in a defined pattern. In one embodiment, the holes or transparencies are configured to form a pattern such as a logo or text on the surface. In one embodiment, a laser beam can be used to develop a specific portion of the photoresist without using a photomask.

The surface is then exposed to a specific pattern of intense light to develop a portion of the photoresist into a mask. The light can be in the form of an ultraviolet laser, such as a deep ultraviolet light (DUV) laser. The undeveloped portion can then be removed using a photoresist developer solution, containing for example, sodium hydroxide (NaOH) or tetramethylammonium hydroxide (TMAH). The remaining photoresist can then be hard-baked to solidify so as to form a mask on the surface. As but one non-limiting example, the photoresist can be baked from about 20 minutes to about 30 minutes at a temperature from about 120° C. to about 180° C. This process can serve to solidify the photoresist and improve adhesion of the photoresist to the surface in order to make a durable mask suitable to fully or partially protect the masked surface during subsequent treatment processes.

Process 10 further includes an act 16 of texturizing the surface. Act 16 can include performing a texturizing treatment on the surface to create a textured pattern across the unmasked portion of the surface. This can result in one or more functional, tactile, cosmetic, or other effects on the surface. In one such process, the unmasked surface can be texturized to roughen the surface, shape the surface, remove surface contaminants, or other effects. For example, the texturizing act can produce a desired tactile effect, reduce the appearance of minor surface defects, and/or reduce the appearance of fingerprints or smudges. In addition, the texturizing act can be used to create a series of small peaks and valleys. These peaks and valleys can impart a sparkling effect to the surface, which can in some instances make the unmasked surface appear brighter.

The thickness, as well as other properties of the mask, can be adjusted such that the masked portion is substantially unaffected following the texturizing act or any of the other treatment acts described herein. Alternatively, the mask can reduce the effects of any treatment acts on the underlying surface of the masked portion compared to the unmasked portion of the surface. For example, the masked portion can produce a smaller series of peaks and valleys following texturizing act 16 compared to the unmasked portion.

The texturizing process can be accomplished via one or more mechanical processes such as by machining, brushing, or abrasive blasting. Abrasive blasting, for example, involves forcibly propelling a stream of abrasive material, such as beads, sand, and/or glass, against the surface. In some embodiments, suitable zirconia or iron beads can be used to achieve a desired surface finish. Alternatively, the surface can be texturized through a chemical process, such as by chemical etching. This process can involve the use of an etching solution, such as an alkaline etching solution.

The alkaline etching solution can be a sodium hydroxide (NaOH) solution. The concentration of the NaOH solution can range from about 50 to about 60 g/l, from about 51 to about 59 g/l, from about 52 to about 58 g/l, from about 53 to about 57 g/l, or from about 54 to about 56 g/l, or can be about 55 g/l. The NaOH solution can have a temperature of about 50 degrees Celsius. The surface can be exposed to the NaOH solution for a time period that can range from about 5 to about 30 seconds, from about 10 to about 25 seconds, or from about 15 to about 20 seconds. These parameters are merely exemplary and can be varied. Other suitable alkaline etching solutions can be used, including, but not limited to ammonium bifluoride ($NH_4F_2$).

Process 10 additionally includes an act 17 of removing the mask from the metal surface. By way of example, the mask can be removed from the surface by application of a liquid resist stripper, which can chemically alter the resist so that it no longer adheres to the surface. The mask can be removed before or after any treatment process described herein to achieve a desired effect. For example, the mask can be removed before or after texturizing, anodizing, dyeing, or polishing. The mask can be configured to be partially or fully removed without performing a separate removal act. For example, the mask can be configured to be partially or fully removed as a result of the texturizing processes itself. Likewise, the mask can be configured to be partially or fully removed during an anodization or polishing process.

Process 10 additionally includes an act 18 of performing an anodization process on the metal surface. Anodizing a metal surface converts a portion of the metal surface into a metal oxide, thereby creating a metal oxide layer. Anodized metal surfaces can provide increased corrosion resistance and wear resistance and may also be used to obtain a cosmetic effect. For example, an oxide layer formed during the anodization process can be used to facilitate the absorption of dyes or metals to impart a desired color to the anodized metal surface.

An exemplary anodization process includes placing the metal surface in an electrolytic bath having a temperature in a range from about 18 to about 22 degrees Celsius. Hard anodization can be accomplished by placing the metal surface in an electrolytic bath having a temperature in a range from about 0 to about 5 degrees Celsius.

In one embodiment, anodizing act 18 can create a transparent effect to the metal surface. In this embodiment, the metal surface can be placed in an electrolytic bath that has been optimized to increase the transparent effect of the oxide layer. The electrolytic bath can include sulfuric acid ($H_2SO_4$) in a concentration having a range from about 150 to about 210 g/l, from about 160 and to about 200 g/l, from about 170 to about 190 g/l, or about 180 g/l. The electrolytic bath can also include metal ions that are the same metal as that which forms the metal surface. For example, the metal surface can be formed of aluminum, and the electrolytic bath can include aluminum ions, in a concentration of less than about 15 g/l or in a range from about 4 to about 10 g/l, from about 5 to about 9 g/l, or from about 6 to about 8 g/l, or can be about 7 g/l. A current is passed through the solution to anodize the article. Anodization can occur at a current density in a range from about 1.0 to about 2.0 amperes per square decimeter. Anodization can have a duration in a range from about 30 minutes to about 60 minutes, or from about 35 to about 55 minutes, or from about 40 to about 50 minutes, or can be about 45 minutes. The thickness of the oxide layer can be controlled in part by the duration of the anodization process.

In order to achieve an oxide layer with a desired transparency, the thickness of the oxide layer can range from about 10 microns to about 20 microns, or from about 11 to about 19 microns, or from about 12 microns to about 18 microns, or from about 13 to about 17 microns, or from about 14 microns to about 16 microns, or about 15 microns. Pores are formed in the oxide layer during the anodization process, and in one embodiment are spaced approximately 10 microns apart. The diameter of each of the pores can range from 0.005 to about 0.05 microns, or from 0.01 to about 0.03 microns. The above dimensions are not intended to be limiting.

Figure 2:
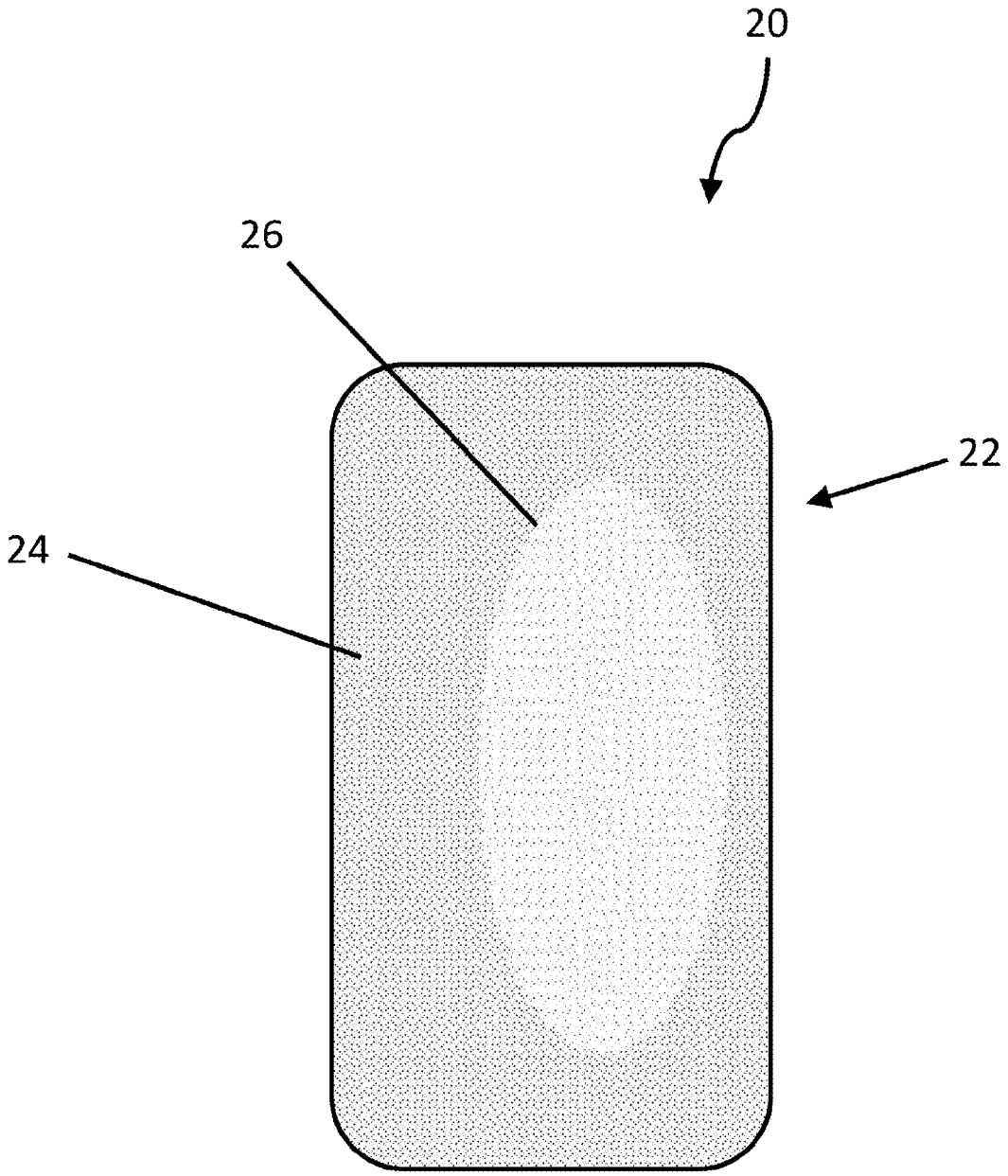
FIG. 2 illustrates a top view of a surface that has been treated in accordance with the process of FIG. 1.

FIG. 2 illustrates an exemplary article 20 treated in accordance with process 10. Surface 22 includes a first portion 24 and a second portion 26 which exhibit different functional, tactile, cosmetic, or other effects. For example, in one embodiment, first portion 24 can be the unmasked portion and can be treated via texturizing act 16 described herein, and second portion 26 can be the masked portion and is not be subject to texturizing act 16. In another embodiment, first portion 24 is the masked portion, and second portion 26 is the unmasked portion.

In another embodiment, first portion 24 and second portion 26 can be treated by different techniques. For example, as described herein, one or more treatments can be repeated over a portion to achieve a desired contrasting effect. As another example, first portion 24 can be subjected to abrasive blasting or chemical etching and second portion 26 can be subjected to other texturizing treatments described herein. Surface portions 24 and 26 can be treated to have different degrees of scratch or abrasion resistance. For example, one technique can include standard anodization on one portion of the surface and another technique can include hard anodization on another portion of the surface. As another example, one technique can polish to a different surface roughness one portion of the surface compared to another technique performed on another portion of the surface. The different patterns or visual effects on surface 22 that are created can include, but are not limited to, stripes, dots, or the shape of a logo. In one embodiment, surface 22 includes a logo. In this example, first portion 24 contains the logo and second portion 26 does not contain the logo. In other embodiments, the difference in techniques can create the appearance of a logo or label, such that a separate logo or label does not need to be applied to surface 22. In one embodiment, a first metal is deposited (via a metal deposition process) within the pores of the oxide layer on the first portion of the article, and a second metal is deposited (via a metal deposition process) within the pores of the oxide layer on the second portion of the article. The portion with the second mask can overlap or be entirely different from the surface portion to which the first mask was applied.

In some embodiments, act 14 of applying a mask to a portion of the surface can be repeated on the same or another portion of surface 22 following a first surface treatment according to process 10, or any of the other surface treatment processes described herein (e.g., the processes described with respect to FIG. 1, 3, or 5-8) in order to achieve desired functional, tactile, cosmetic, or other effects for surface 22.

Figure 3:
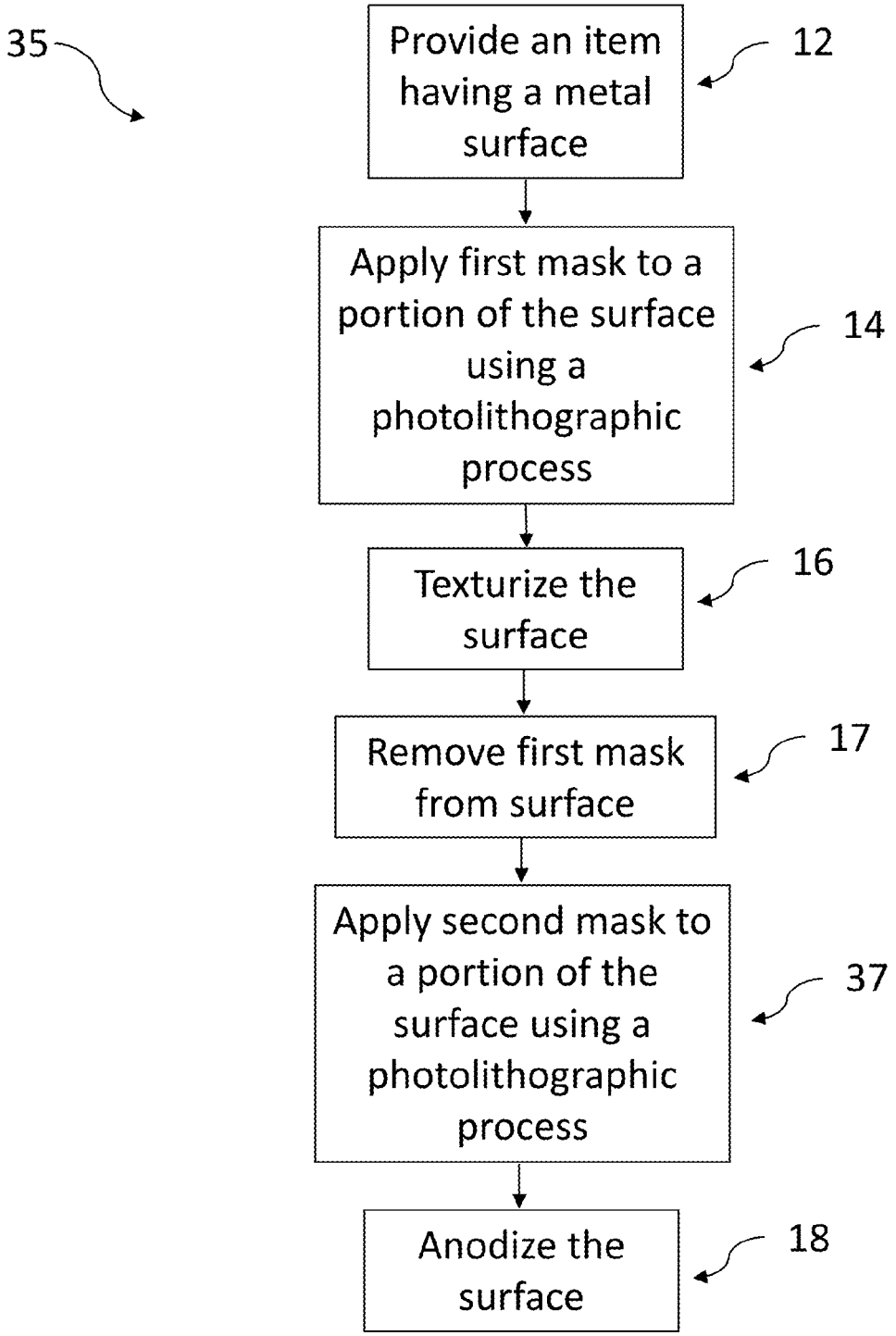
FIG. 3 is a flowchart of a surface treatment process in accordance with one embodiment of the present application.

FIG. 3 is a high-level flowchart of an exemplary surface treatment process 35. Process 35 includes the acts described above of providing an article having a metal surface 22 (act 12), applying a mask to a portion of surface 22 using a photolithographic process (act 14), texturizing surface 22 (act 16), removing the mask from surface 22 (act 17), and anodizing surface 22 (act 18). Process 35 further includes an act 37 of applying a second mask to a portion of surface 22.

Figure 4:
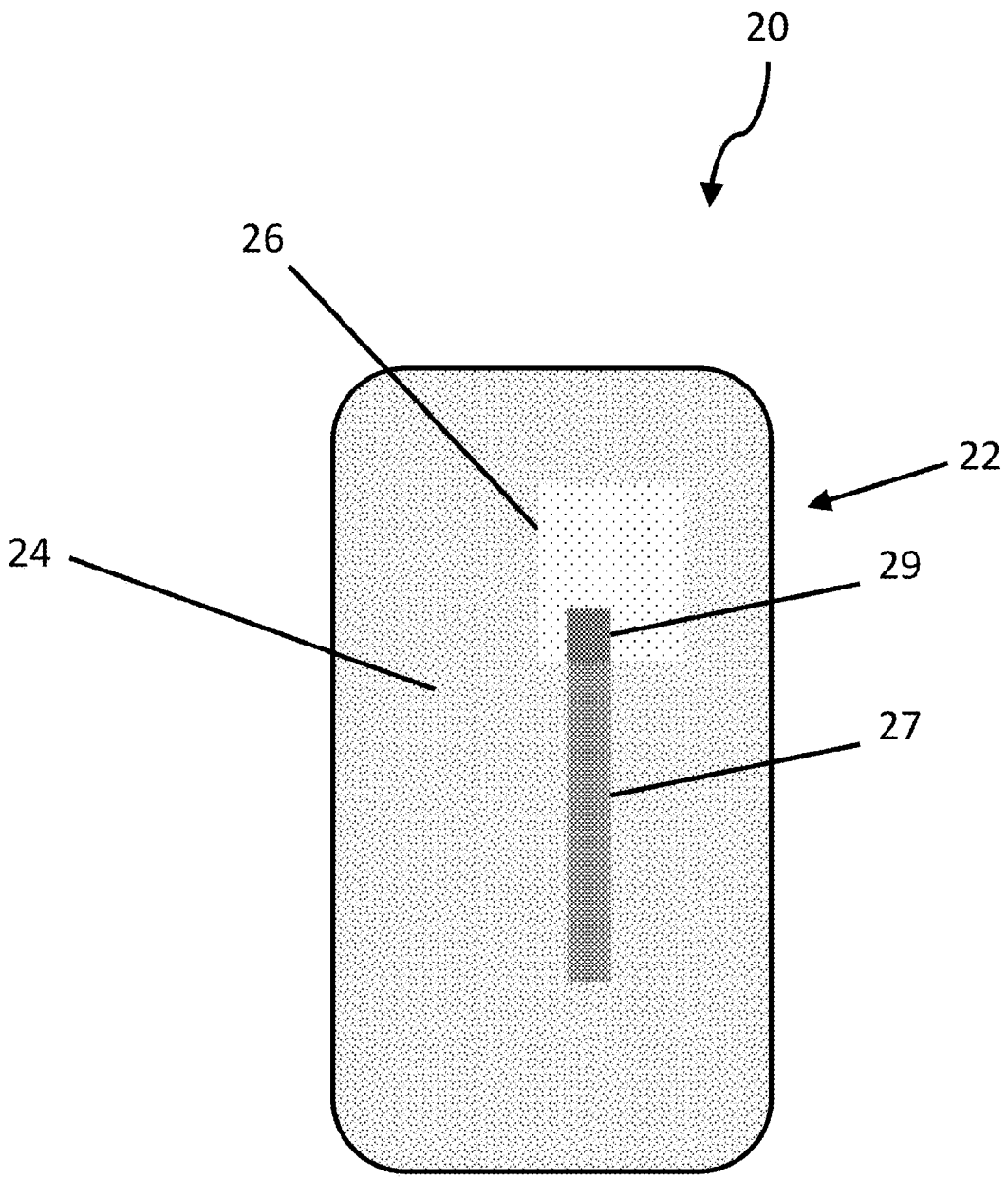
FIG. 4 illustrates a top view of a surface that has been treated in accordance with the process of FIG. 3.

FIG. 4 illustrates an exemplary article 20 treated in accordance with process 35. Surface 22 includes a first portion 24, a second portion 26, a third portion 27, and a fourth portion 29, each of which exhibit different functional, tactile, cosmetic, or other effects. Third portion 27 and fourth portion 29 can be formed, as described above, by performing a second masking process after a first mask is removed from surface 22. The second masked portion (including third portion 27 and fourth portion 29) can partially overlap with the first masked portion (including second portion 26 and fourth portion 29). This process can create four distinct portions of surface 22, each of which has a different functional, tactile, cosmetic, or other effect.

Figure 5:
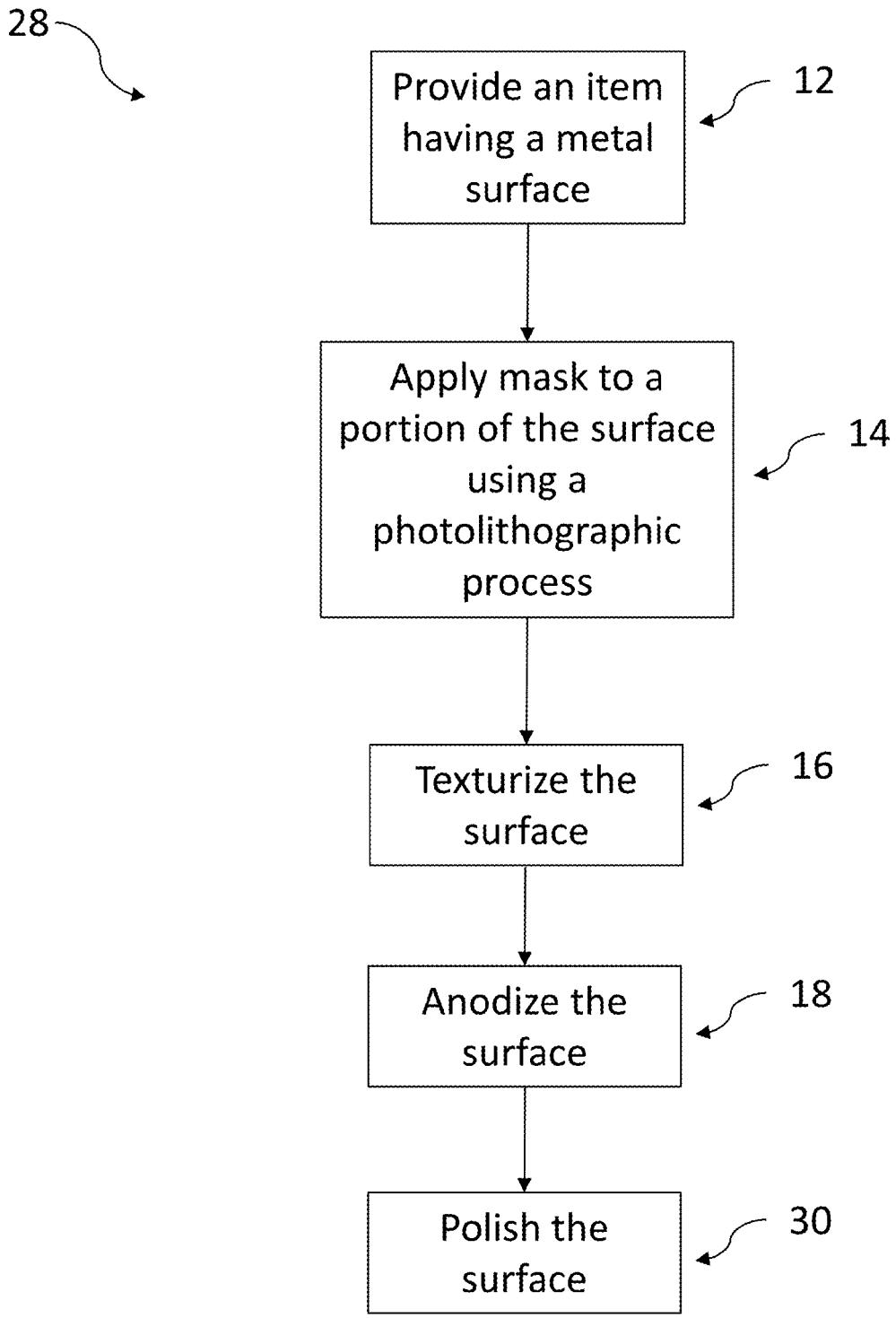
FIG. 5 is a flowchart of a surface treatment process in accordance with one embodiment of the present application.

FIG. 5 is a high-level flowchart of an exemplary surface treatment process 28. Process 28 includes the acts described above of providing an article having a metal surface 22 (act 12), applying a mask to a portion of surface 22 using a photolithographic process (act 14), texturizing surface 22 (act 16), and anodizing surface 22 (act 18). Process 28 further includes an act 30 of polishing surface 22.

Act 30 of polishing surface 22 can be accomplished through any suitable polishing methods, such as buffing or tumbling. This act can be performed manually or with machine assistance. In one embodiment, buffing can be accomplished by polishing surface 22 using a work wheel having an abrasive surface. In one embodiment, surface 22 can be polished via tumbling, which involves placing the article in a tumbling barrel filled with a media and then rotating the barrel with the object inside it. Polishing act 30 can impart a smooth, glassy appearance to surface 22. For example, polishing act 30 can include tumbling the article in a barrel for about 2 hours at a rotational speed of about 140 RPM. In some embodiments, the volume of the barrel can be about 60% filled, and the media can be crushed walnut shells mixed with a cutting media suspended in a lubricant, such as a cream.

In some embodiments, polishing act 30 includes an automated buffing process, which can be a multi-stage process. An exemplary multi-stage process for automated buffing can include four stages. In a first stage, the surface can be buffed for about 17 seconds with a pleated sisal wheel coated with an oil having coarse aluminum oxide particles suspended therein. In a second stage, the surface can be buffed in a cross direction from the buffing of the first stage for about 17 seconds with a pleated sisal wheel coated with an oil having coarse aluminum oxide particles suspended therein. In a third stage, the surface can be buffed for about 17 seconds with an un-reinforced cotton wheel coated with an oil having finer aluminum oxide particles suspended therein than the coarse aluminum oxide particles utilized in the first and second stages. In a fourth stage, the surface can be buffed for about 17 seconds with a flannel wheel coated with an oil having finer aluminum oxide particles suspended therein than the coarse aluminum oxide particles utilized in the first through third stages. The type of abrasive particles, the size of the abrasive particles, the duration of the stage, and the material of the wheel described above for each stage, as well as the number of stages, are merely exemplary and can be varied.

Polishing act 30 can additionally or alternatively include the use of a chemical polishing solution. The chemical polishing solution can be an acidic solution. Acids that can be included in the solution include, but are not limited to, phosphoric acid ($H_3PO_4$), nitric acid ($HNO_3$), sulfuric acid ($H_2SO_4$), and combinations thereof. The acid can be phosphoric acid, a combination of phosphoric acid and nitric acid, a combination of phosphoric acid and sulfuric acid, or a combination of phosphoric acid, nitric acid and sulfuric acid. Other additives for the chemical polishing solution can include copper sulfate ($CuSO_4$) and water. In one embodiment, a solution of 85% phosphoric acid is maintained at a temperature of about 95 degrees Celsius. The processing time of the chemical polishing act can be adjusted depending upon a desired target gloss value. In one embodiment, the processing time can be in a range from about 40 seconds to about 60 seconds. In addition, polishing act 30 can be accomplished utilizing other methods that would result in polishing the surface to increase the gloss of the surface.

In some embodiments, polishing act 30 results in a high quality surface with no orange peel, no waviness, and no defects. All die lines, stamping marks, drawing marks, shock lines, cutter marks, roughness, waviness, and/or oil and grease are removed from the surface. In some embodiments, a similar polishing treatment can be performed before the anodization act 18 described above.

Figure 6:
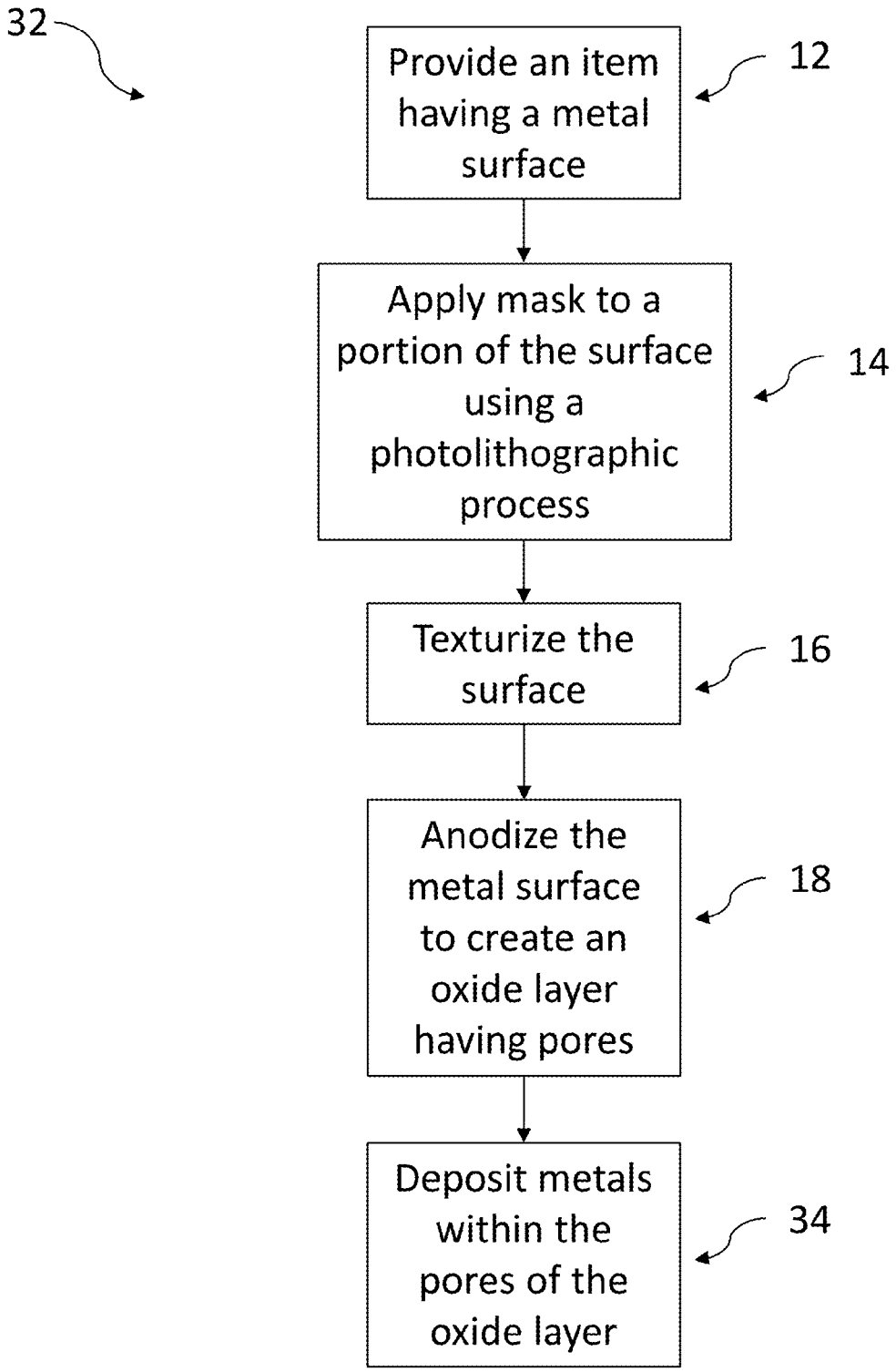
FIG. 6 is a flowchart of a surface treatment process in accordance with one embodiment of the present application.

FIG. 6 is a high-level flowchart of an exemplary surface treatment process 32. Process 32 includes the acts described above of providing an article having a metal surface 22 (act 12), applying a mask to a portion of surface 22 using a photolithographic process (act 14), texturizing surface 22 (act 16), and anodizing surface 22 (act 18). Process 32 further includes an act 34 of depositing metals within pores of the oxide layer of surface 22.

By way of example, process 32 can further include an act 38 of depositing a metal within the pores of the oxide layer formed during anodization to impart a desired color below the surface and into the pores of the oxide layer. In one embodiment, following anodization article 20 is immersed in an electrolyte bath including a metal salt in solution. For example, the metal salt can include a salt of nickel, tin, cobalt, copper, or any other suitable metal. An alternating or direct current is then applied to the electrolyte bath so that the metal ions of the salt come out of the solution and deposit as a metal in the base of the pores of the oxide layer. The deposited metal can be the same or different color from metal surface 22 or the oxide layer. The combination of colors can result in surface 22 having a desired color. In one embodiment, the deposited metal fills less than half the volume of each pore.

Figure 7:
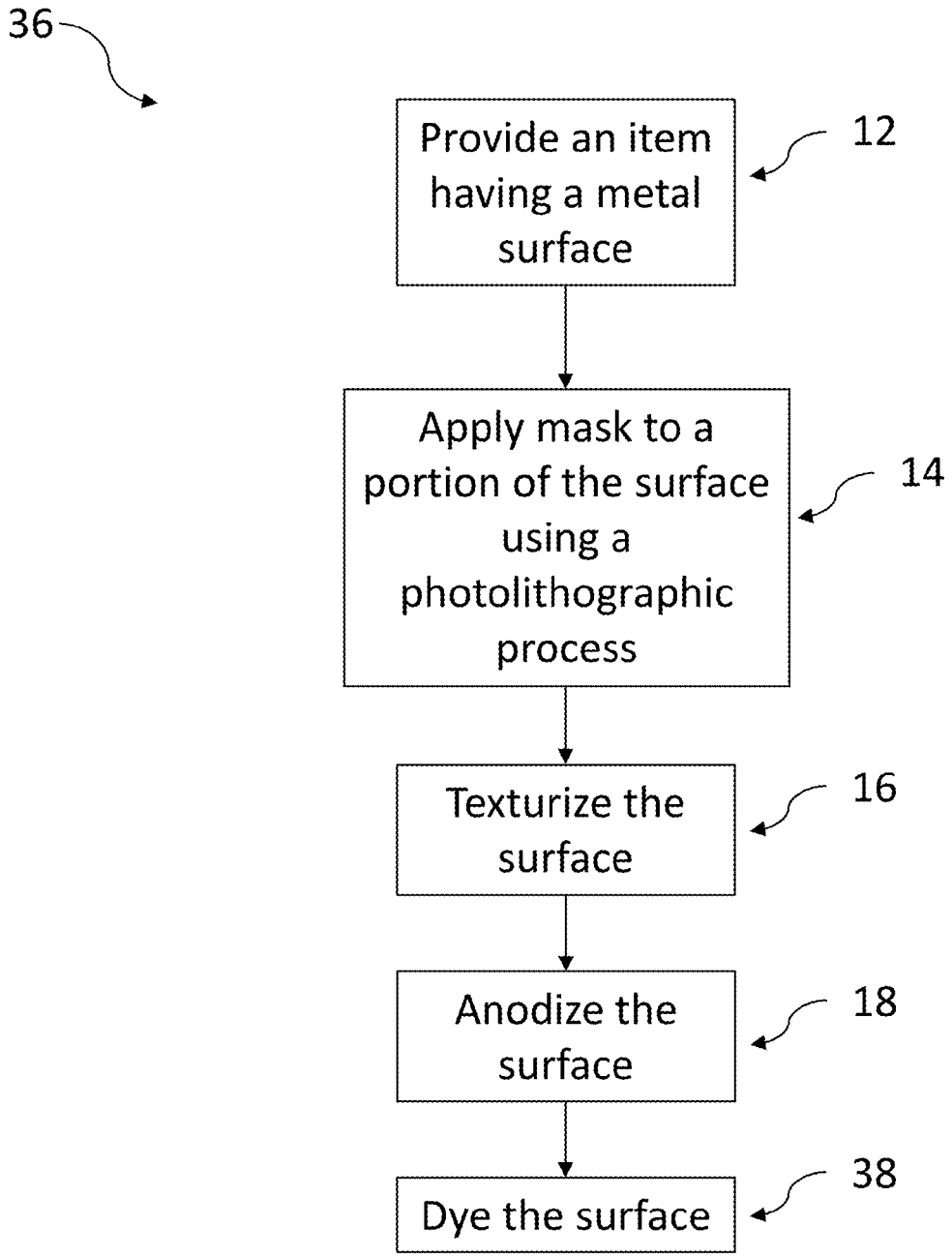
FIG. 7 is a flowchart of a surface treatment process in accordance with one embodiment of the present application.

FIG. 7 is a high-level flowchart of an exemplary surface treatment process 36. Process 36 includes the acts described above of providing an article having a metal surface 22 (act 12), applying a mask to a portion of surface 22 using a photolithographic process (act 14), texturizing surface 22 (act 16), and anodizing surface 22 (act 18). Process 36 further includes an act 38 of dyeing surface 22.

By way of example, act 38 of dyeing surface 22 can include dipping or immersing surface 22 or the entire article 20 in a dye solution in order to impart a color to surface 22. In one embodiment, dye can be absorbed within pores of an oxide layer formed during anodization act 18. In some embodiments, the particle size of the dye molecule is from about 5 nm to about 60 nm, or from about 15 nm to about 30 nm. The act of dyeing the oxide layer can include dyeing the oxide layer and/or any deposited metals in the pores of the oxide layer. In one embodiment, an organic dye is used to dye the oxide layer. A suitable inorganic dye can be used to dye the oxide layer. Any suitable combination of organic and inorganic dyes can be used. In one embodiment, the color of the dye is different from the color of metal deposited within the pores of the oxide layer.

In one embodiment, the dye solution can be maintained at a temperature in a range from about 50 to about 55 degrees Celsius and can contain a stabilizer to control the pH of the dye solution. A variety of colors can be achieved depending upon the particular dye composition, dye concentration, and/or duration of dyeing. A variety of colors for the surface can be achieved by varying the dye composition, the concentration of the dye and the duration of dyeing based on visualization and/or experimentation. Color control can be achieved by measuring the surface with a spectrophotometer and comparing the value against an established standard.

Figure 8:
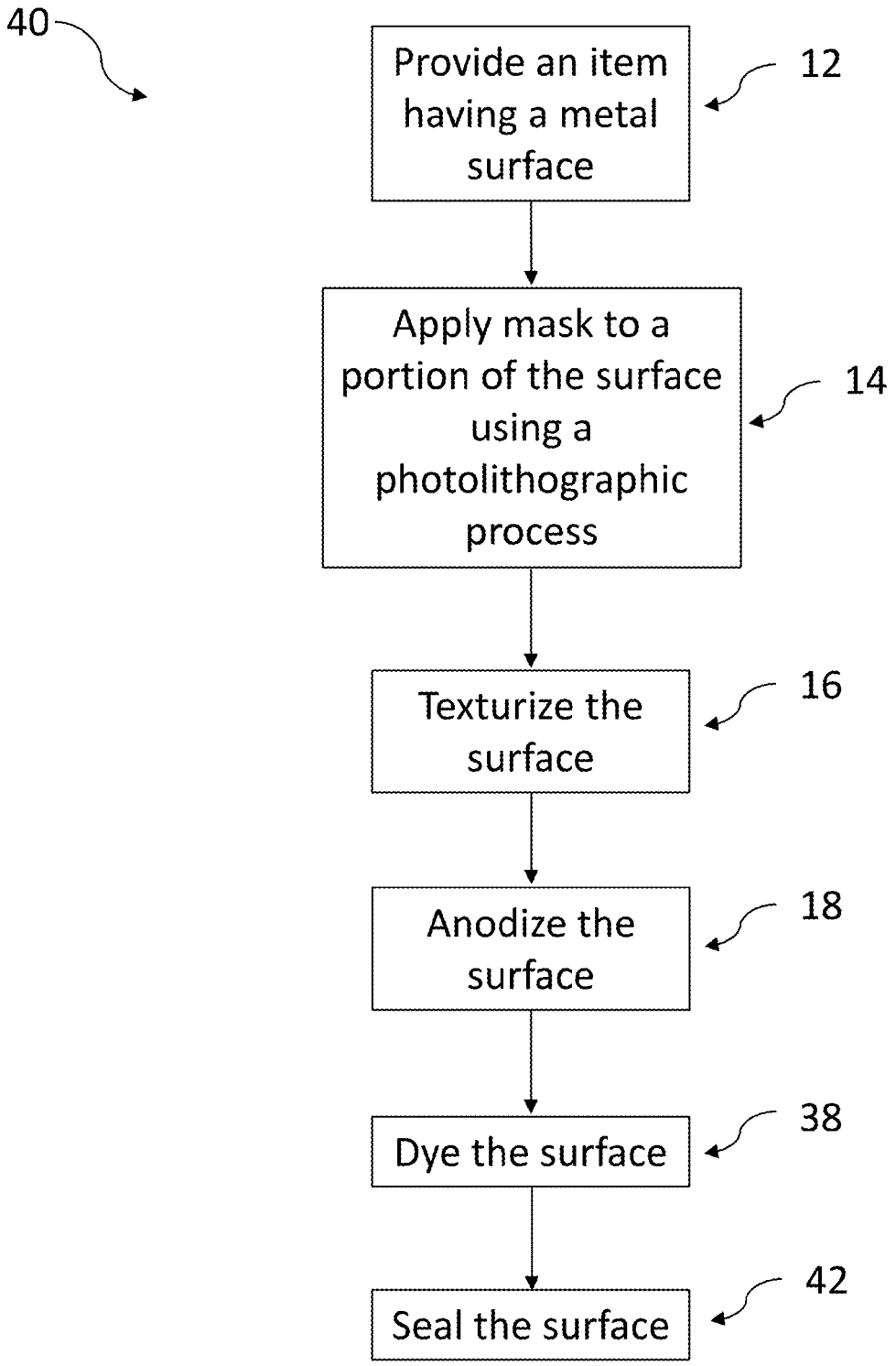
FIG. 8 is a flowchart of a surface treatment process in accordance with one embodiment of the present application.

FIG. 8 is a high-level flowchart of an exemplary surface treatment process 40. Process 40 includes the acts described above of providing an article having a metal surface 22 (act 12), applying a mask to a portion of surface 22 using a photolithographic process (act 14), texturizing surface 22 (act 16), anodizing surface 22 (act 18), and dyeing surface 22 (act 38). Process 40 further includes an act 42 of sealing surface 22.

By way of example, act 42 of sealing the surface can include sealing the pores of the oxide layer. This can include immersing surface 22 in a sealing solution to seal pores in the oxide layer. The sealing process can include placing the surface in a solution for a sufficient amount of time to create a sealant layer that seals the pores. The sealing, solution can include, but is not limited to, nickel acetate. The sealing solution can be kept at a temperature in a range from about 90 to about 95 degrees Celsius. The surface can be immersed in the solution for a period of at least 15 minutes. In some embodiments, the sealing is performed using hot water or steam to convert a portion of the oxide layer into its hydrated form. This conversion allows the oxide layer to swell, thus reducing the size of the pores.

Additionally, any of the above methods can include one or more further treatments on surface 22, such as rinsing, degreasing, desmutting, dyeing, sealing, polishing, texturizing, brightening, or anodization.

It is noted that the acts discussed above, illustrated in the flowcharts of FIGS. 1, 3, and 5-8 are for illustrative purposes and are merely exemplary. Not every act need be performed and additional acts can be included as would be apparent to one of ordinary skill in the art to create a surface 22 having a desired effect. The acts can be reordered as desired. For example, act 30 of polishing the metal surface can be performed before or after the texturizing act 16 as well as before or after the anodizing act 18.

EXAMPLES

Example 1

In one prophetic example, a surface treatment process in accordance with one embodiment of the present application is applied to an aluminum housing for a portable media player. The housing is first rinsed to remove any debris. An SU-8 negative photoresist is then uniformly applied to a surface of the housing. A portion of the photoresist is covered with a photomask including an opaque plate with holes that allow light to shine through in a defined pattern in the shape of a logo.

The surface is then exposed to an ultraviolet light beam to render the uncovered portion soluble to a photoresist developer solution. The soluble photoresist is then removed using a photoresist developer solution containing sodium hydroxide (NaOH). The remaining photoresist is then hard-baked at 150° C. for 20 minutes to form a mask.

After the mask cools, the housing is placed in a chemical etching solution containing NaOH for approximately 20 seconds. After this process, the housing is removed from the solution and rinsed with clean water. Following the chemical etching process, the mask is removed from the surface using a liquid resist stripper.

The housing is then anodized to create an oxide layer. In this process, the housing is placed in an electrolytic bath having a temperature of about 20 degrees Celsius. A current having a current density of about 1.5 amperes per square decimeter is passed between a cathode in the solution and the article to create a build-up of aluminum oxide on the article. This process is performed for approximately 40 minutes and can result in an oxide layer being formed on the surface of the housing. After this process, the housing is removed from the bath and rinsed with clean water.

The housing is then chemically polished by placing the article in a solution of 85% phosphoric acid for about 40 seconds. Following this process, the housing is rinsed with clean water and buffed for about 20 seconds with a pleated sisal wheel coated with an oil having coarse aluminum oxide particles suspended therein.

This example surface treatment process can be used to achieve the effects of the surface 22 of FIG. 2, for example, in which portion 24 corresponds to one of the masked and unmasked portions and portion 26 corresponds to the other of the unmasked and masked portions.

The above processes can provide a surface having a desired effect, such as functional properties or cosmetic appearance (e.g., a desired pattern). For example, in some embodiments, the processes can achieve corrosion resistance and can additionally provide a pattern in the surface formed by contrasting effects. The processes described herein also allow for a wide variation effects to be imparted to a surface.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

In addition, the breadth and scope of the present invention should not be limited by any of the above-described exemplary embodiments, but should be defined only in accordance with the following claims and their equivalents.

The invention claimed is:

1. A method of forming a varied pattern on an surface of a substrate, the surface including a first portion, a second portion, a third portion, and a fourth portion, wherein the first portion abuts the second portion at a surface boundary, the method comprising:

applying a first mask on the first portion and the second portion, leaving the third portion and the fourth portion exposed;

exposing the third portion and the fourth portion to a first texturing process;

removing the first mask;

applying a second mask on the second portion and the third portion, leaving the first portion and the fourth portion exposed;

imparting a first surface texture to the first portion and a fourth surface texture to the fourth portion by exposing the first portion and the fourth portion to a second texturing process;

removing the second mask, thereby revealing a second surface texture of the second portion and a third surface texture of the third portion, wherein the first, second, third and fourth surface textures are different from each other;

forming a first anodized layer that overlays the first portion, the first anodized layer characterized as having a first abrasion resistance; and forming a second anodized layer that overlays the second portion, the second anodized layer characterized as having a second abrasion resistance different from the first abrasion resistance, wherein the first anodized layer abuts the second anodized layer at a layer boundary that coincides with the surface boundary.

2. The method of claim 1, wherein the first texturing process includes at least one of machining, brushing, abrasive blasting, chemical etching, or polishing.

3. The method of claim 1, wherein the substrate is composed of an aluminum alloy.

4. The method of claim 1, wherein the first anodized layer and the second anodized layer are composed of metal oxide.

5. The method of claim 1, wherein one of the first and the second anodized layers is a hard anodized layer and another of the first and the second anodized layers is a standard anodized layer.

6. The method of claim 1, wherein the first portion or the second portion has a shape of stripes, dots, a logo or a text.

7. The method of claim 1, wherein the substrate is a housing for an electronic device.

8. A method of forming a textured pattern on an surface of a housing for an electronic device, the method comprising:

applying a first mask to the surface so that a first portion of the surface is exposed and a second portion of the surface is masked, wherein the first portion abuts the second portion at a surface boundary;

exposing the first portion to a first texturing process so that a first surface texture is imparted on the first portion;

removing the first mask from the surface;

applying a second mask to the surface using a first masking process so that a subsection of the first portion and a subsection of the second portion are exposed and a remaining portion of the first portion and a remaining portion of the second portion are masked;

exposing the subsection of the first portion and the subsection of the second portion to a second texturing process so that the subsection of the first portion that exhibits the first surface texture is exposed to the second texturing process, wherein the second texturing process is different from the first texturing process;

removing the second mask from the surface so that the first surface texture on the remaining portion of the first portion is revealed;

forming a first anodized layer on the first portion, the first anodized layer characterized as having a first abrasion resistance; and forming a second anodized layer that overlays the second portion, the second anodized layer characterized as having a second abrasion resistance different from the first abrasion resistance, the first anodized layer adjacent the second anodized layer at an anodized layer boundary that coincides with the surface boundary.

9. The method of claim 8, wherein the first texturing process includes at least one of machining, brushing, abrasive blasting, chemical etching, or polishing.

10. The method of claim 8, further comprising performing a metal deposition process to deposit a metal within the first anodized layer or the second anodized layer.

11. The method of claim 8, further comprising dyeing at least one of the first anodized layer or the second anodized layer.

12. The method of claim 8, wherein the housing is composed of an aluminum alloy, and the first anodized layer and the second anodized layer are each composed of a corresponding metal oxide.

13. A method of forming a textured pattern on an surface of a substrate, the surface including a first portion, a second portion and a third portion, the method comprising:

applying a first mask on the first portion and the second portion, leaving the third portion exposed;

exposing the third portion to a first texturing process;

removing the first mask;

applying a second mask on the second portion, leaving the first portion and the third portion exposed;

exposing the first portion and the third portion to a second texturing process, such that a first surface texture is imparted to the first portion and a third surface texture is imparted to the third portion;

removing the second mask revealing a second surface texture of the second portion;

forming a first anodized layer on the first portion, the first anodized layer characterized as having a first abrasion resistance; and forming a second anodized layer that overlays the second portion, the second anodized layer characterized as having a second abrasion resistance different from the first abrasion resistance, wherein the second anodized layer meets the first anodized layer at a boundary, and wherein a transition between the first surface texture of the first portion and the second surface texture of the second portion coincides with the boundary.

14. The method of claim 13, wherein the first anodized layer is a standard anodized layer and the second anodized layer is a hard anodized layer.

15. The method of claim 13, further comprising prior forming the first surface texture, polishing the surface of the substrate.

16. The method of claim 13, wherein the substrate is composed of an aluminum alloy.

* * * * *